US007854690B2

(12) United States Patent
Trevino et al.

(10) Patent No.: US 7,854,690 B2
(45) Date of Patent: Dec. 21, 2010

(54) TREADMILL

(75) Inventors: Richard W. Trevino, Whitehouse, TX (US); Bradley J. Smith, Tyler, TX (US)

(73) Assignee: Nautilus, Inc., Vancouver, WA (US)

( * ) Notice: Subject to any disclaimer, the term of this patent is extended or adjusted under 35 U.S.C. 154(b) by 0 days.

(21) Appl. No.: 12/481,144

(22) Filed: Jun. 9, 2009

(65) Prior Publication Data

US 2009/0312158 A1 Dec. 17, 2009

Related U.S. Application Data

(63) Continuation of application No. 11/463,297, filed on Aug. 8, 2006, now Pat. No. 7,544,153, which is a continuation of application No. 10/039,070, filed on Dec. 31, 2001, now Pat. No. 7,455,626.

(51) Int. Cl.
*A63B 22/00* (2006.01)

(52) U.S. Cl. ..... 482/54; 482/51; 119/700

(58) Field of Classification Search ..... 482/51, 482/54; 119/700

See application file for complete search history.

(56) References Cited

U.S. PATENT DOCUMENTS

| | | | | |
|---|---|---|---|---|
| 931,394 | A | 8/1909 | Day | |
| 4,544,153 | A | 10/1985 | Babcock | |
| 4,572,500 | A | 2/1986 | Weiss | |
| 4,679,787 | A | 7/1987 | Guilbault | |
| 4,817,939 | A | 4/1989 | Augspurger et al. | |
| 4,844,449 | A | 7/1989 | Truslaske | |
| 5,007,630 | A * | 4/1991 | Real et al. | 482/54 |
| 5,072,928 | A | 12/1991 | Stearns et al. | |
| 5,302,162 | A | 4/1994 | Pasero | |
| 5,336,146 | A | 8/1994 | Piaget et al. | |
| 5,407,408 | A | 4/1995 | Wilkinson | |
| 5,431,612 | A * | 7/1995 | Holden | 482/54 |
| 5,476,431 | A | 12/1995 | Wilkinson et al. | |
| 5,518,471 | A | 5/1996 | Hettinger et al. | |
| 5,662,557 | A | 9/1997 | Watterson et al. | |

(Continued)

FOREIGN PATENT DOCUMENTS

| | | | |
|---|---|---|---|
| TW | 408611 | Y | 10/2000 |

OTHER PUBLICATIONS

Office Action and PTO-892, U.S. Appl. No. 10/039,070, mailed Oct. 1, 2004, 5 pages.

(Continued)

*Primary Examiner*—Glenn Richman
(74) *Attorney, Agent, or Firm*—Dorsey & Whitney LLP

(57) ABSTRACT

An articulating treadmill is disclosed that includes a support frame, a motor frame, and a base frame. The motor frame is pivotally attached to the support frame along a first pivot line, and the base frame is pivotally attached to motor frame along a second pivot line spaced from the first pivot line. The base frame pivots about the second pivot line from an unfolded configuration to a folded configuration, and vice versa. The treadmill includes an elevation motor having an extension arm. The elevation motor is attached between the motor frame and a base of the support frame. As the extension arm of the elevation motor extends or retracts, the incline of the treadmill support bed increases or decreases, respectively. The treadmill also includes an adjustable roller system.

15 Claims, 12 Drawing Sheets

U.S. PATENT DOCUMENTS

| | | | | |
|---|---|---|---|---|
| 5,669,857 | A | 9/1997 | Watterson et al. | |
| 5,672,140 | A | 9/1997 | Watterson et al. | |
| 5,674,156 | A | 10/1997 | Watterson et al. | |
| 5,674,453 | A | 10/1997 | Watterson et al. | |
| 5,676,624 | A | 10/1997 | Watterson et al. | |
| 5,683,332 | A | 11/1997 | Watterson et al. | |
| 5,830,113 | A | 11/1998 | Coody et al. | |
| 5,839,993 | A | 11/1998 | Fox | |
| 5,855,537 | A | 1/1999 | Coody et al. | |
| 5,868,648 | A | 2/1999 | Coody et al. | |
| 6,015,368 | A | 1/2000 | Clem et al. | |
| 6,059,695 | A | 5/2000 | Hung | |
| 6,213,919 | B1 | 4/2001 | Wang et al. | |
| 6,261,209 | B1 | 7/2001 | Coody | |
| 6,325,745 | B1 | 12/2001 | Yu | |
| 6,471,622 | B1 | 10/2002 | Hammer et al. | |
| 6,575,879 | B1 * | 6/2003 | Harney et al. | 482/54 |
| 6,761,667 | B1 | 7/2004 | Cutler et al. | |
| 6,830,540 | B2 | 12/2004 | Watterson et al. | |
| 6,974,404 | B1 | 12/2005 | Watterson et al. | |
| 7,004,887 | B2 | 2/2006 | Pan et al. | |
| 7,104,937 | B2 | 9/2006 | Arbuckle et al. | |
| 7,211,029 | B2 | 5/2007 | Kau | |
| 7,357,758 | B2 * | 4/2008 | Polk et al. | 482/54 |
| 7,455,626 | B2 | 11/2008 | Trevino et al. | |
| 7,544,153 | B2 | 6/2009 | Trevino et al. | |
| 2006/0040798 | A1 | 2/2006 | Weier et al. | |

OTHER PUBLICATIONS

Amendment and Response, U.S. Appl. No. 10/039,070, dated Apr. 1, 2005, 9 pages.
Office Action and PTO-892, U.S. Appl. No. 10/039,070, mailed Jun. 27, 2005, 5 pages.
Amendment and Response to Office Action, U.S. Appl. No. 10/039,070, dated Nov. 28, 2005, 9 pages.
Office Action, U.S. Appl. No. 10/039,070, mailed Feb. 8, 2006, 5 pages.
Amendment and Response to Final Office Action, U.S. Appl. No. 10/039,070, dated Jul. 7, 2006, 5 pages.
Notice of Allowance and Fee(s) Due and Notice of Allowability, U.S. Appl. No. 10/039,070, mailed Aug. 22, 2006, 2 pages.
Office Action and PTO-892, U.S. Appl. No. 10/039,070, mailed Jan. 4, 2007, 5 pages.
Amendment, U.S. Appl. No. 10/039,070, dated Apr. 4, 2007, 7 pages.
Office Action and PTO-892, U.S. Appl. No. 10/039,070, mailed Dec. 12, 2007, 8 pages.
Amendment and Response to Office Action, U.S. Appl. No. 10/039,070, dated Apr. 14, 2008, 9 pages.
Notice of Allowance and Fee(s) Due and Notice of Allowability, U.S. Appl. No. 10/039,070, mailed Jul. 21, 2008, 2 pages.
U.S. Appl. No. 12/816,196, filed Jun. 15, 2010, Weier.

* cited by examiner

TREADMILL

CROSS-REFERENCE TO RELATED APPLICATIONS

This application is a continuation of co-pending U.S. patent application Ser. No. 11/463,297 filed on Aug. 8, 2006 and entitled "Treadmill", which is a continuation application of U.S. patent application Ser. No. 10/039,070 filed on Dec. 31, 2001, now U.S. Pat. No. 7,455,626, which are hereby incorporated herein in their entireties by reference.

BACKGROUND OF THE INVENTION

This invention relates generally to treadmills, and more specifically to articulating treadmills that may be folded upright for storage.

DESCRIPTION OF RELATED ART

Existing articulating treadmills are awkward in use. The weight of the motors must be lifted along with the treadmill frame, complex securing mechanisms are used to lock the treadmill base frame into place, and once the treadmill is secured in the upright position, a user must go around to the other side of the treadmill to move it.

What is needed in the art is an articulating treadmill that allows for the convenient folding of the treadmill frame without requiring a user to lift extra weight, easy securing of the treadmill frame in its storage configuration, and/or ease of movement of the treadmill once it is in its storage configuration without allowing the treadmill to move when it is in its operational configuration.

BRIEF SUMMARY OF THE INVENTION

A treadmill of the present invention is disclosed herein that overcomes the shortcoming discussed above. The treadmill is preferably an articulating treadmill that is easily converted from an unfolded, operational configuration to a folded, generally upright configuration in which it is secured, and vice versa. The treadmill of the present invention is also preferably able to be moved with ease in the folded, generally upright configuration, but also prevents movement of the treadmill in the unfolded, operational configuration.

In a first embodiment, the treadmill of the present invention includes a support frame, a motor frame, and a base frame. The motor frame is pivotally attached to the support frame at a first pivot line, and the base frame is pivotally attached to the motor frame at a second pivot line spaced from the first pivot line. The treadmill includes an elevation motor having an extension arm. The elevation motor is attached between the motor frame and a base of the support frame. As the extension arm of the elevation motor extends or retracts, the incline of the treadmill support bed increases or decreases, respectively.

In another embodiment, the present invention includes a treadmill having an adjustable roller system in which the base frame includes a roller mounted on an axle. The axle is seated in a bushing and includes a threaded recess. The bushing includes a threaded fastener that extends through the bushing into the threaded recess of the axle. The threaded fastener and the axle are adapted to adjust the position of the roller by engaging with the threaded recess of the axle.

In an alternative embodiment, the treadmill of the present invention includes a support frame having a base, a motor frame pivotally attached to the support frame at a first pivot line, and a base frame pivotally attached to the motor frame at a second pivot line spaced from the first pivot line. The base frame pivots about the second pivot line from an unfolded configuration to a folded configuration.

In yet another embodiment, the base frame of the treadmill may be pivoted about the second pivot line to fold the base frame into a generally upright storage position.

In another embodiment, the treadmill of the present invention may also include at least one pivot spring to assist in lifting the base frame from the unfolded, operational configuration to the generally upright, storage position. The pivot spring is preferably located at the second pivot line and is loaded when the base frame is in the unfolded configuration so that the pivot spring urges the base frame in an upward direction.

In yet another embodiment, the treadmill of the present invention may also include a damper to aid a user in unfolding the base frame from the folded, storage position by resisting the downward movement of the base frame. The damper is preferably mounted at a first end to the base frame and at a second end to the motor frame.

In another embodiment, the treadmill of the present invention may also include at least one wheel located at a rear end of the base frame. Preferably the at least one wheel is offset from the bottom surface of the base so that the wheel will only contact the ground if the treadmill is leaned toward the wheel when the base frame is in the folded, generally upright position.

In yet another embodiment, the treadmill of the present invention may also include a means for securing the base frame in the folded, generally upright configuration. Preferably, the treadmill includes a hook attached to the base frame that is engageable with the support frame when the base frame is in the folded, generally upright configuration.

BRIEF DESCRIPTION OF THE DRAWINGS

The preferred embodiments of the invention will be described in detail with reference to the following figures, wherein like numerals refer to like elements, and wherein.

DETAILED DESCRIPTION OF THE INVENTION

Figure 1:
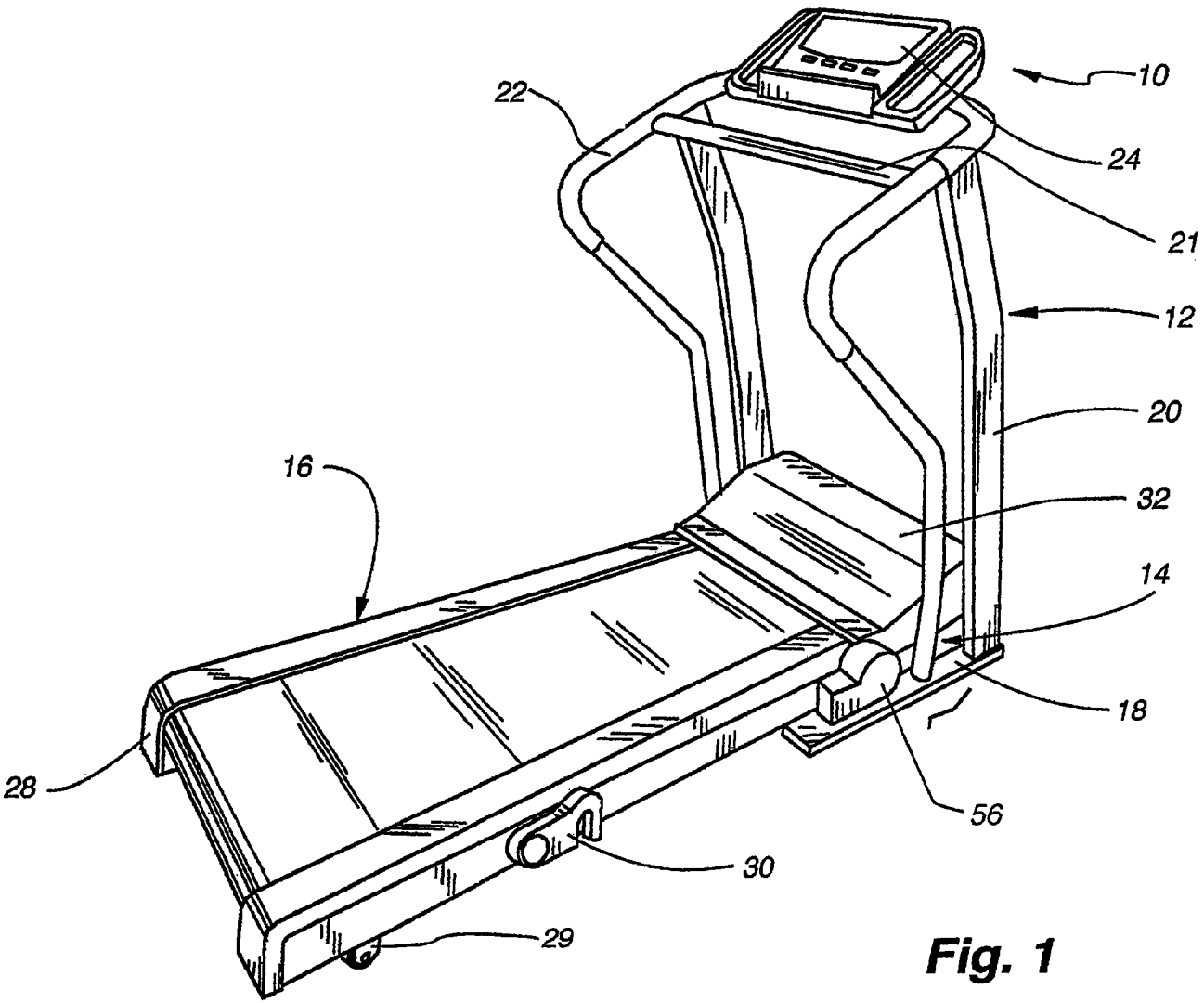
FIG. 1 is a perspective view of one embodiment of a treadmill of the present invention in an unfolded, operational configuration.
Figure 3:
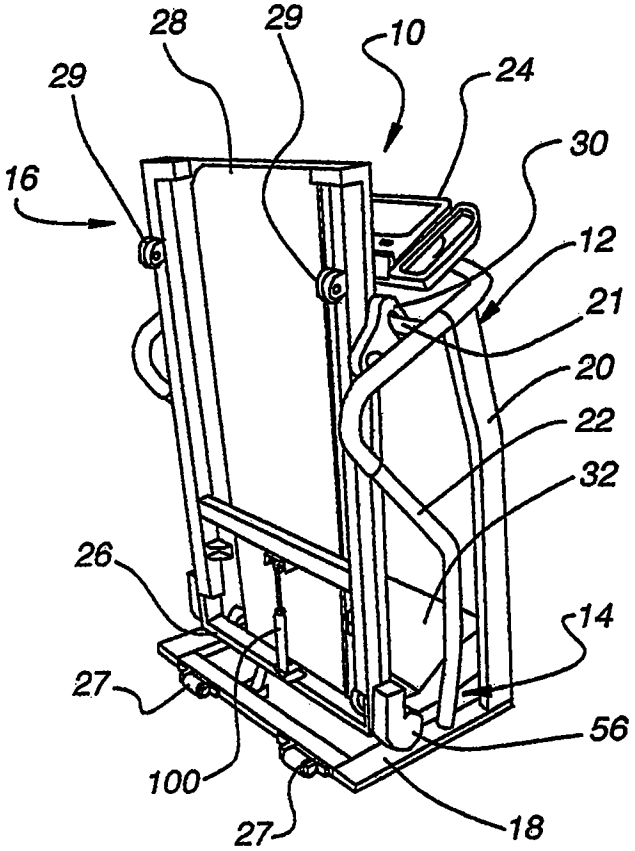
FIG. 3 is a perspective view of the treadmill of FIG. 1 in a folded, upright configuration.
Figure 2:
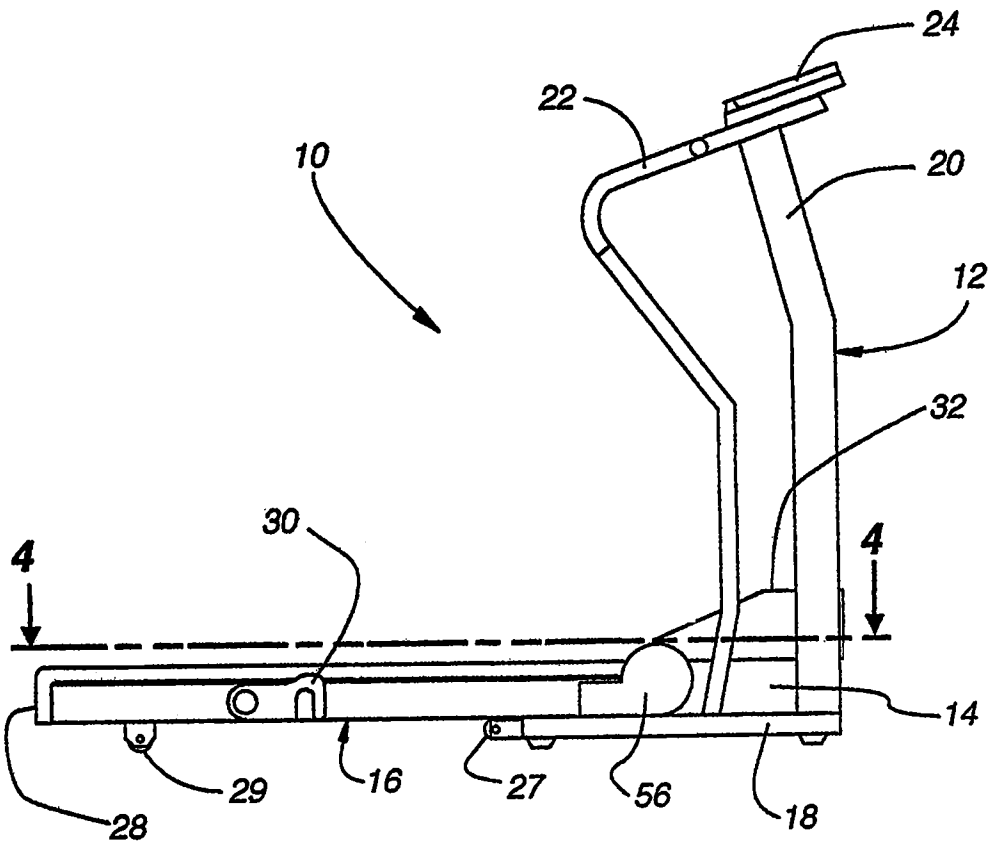
FIG. 2 is a side view of the treadmill of FIG. 1.

FIGS. 1 through 3 show an articulating treadmill 10 of the present invention. FIG. 1 shows a perspective view of the treadmill 10 in an unfolded, operational configuration. FIG. 2 shows a side view of the treadmill 10 in the same configuration as shown in FIG. 1. FIG. 3 shows a perspective view of the treadmill 10 in a folded, generally upright configuration such as may be desired for movement or storage. The treadmill 10 includes a support frame 12, a motor frame 14 and a base frame 16. The support frame 12 provides structural support for the treadmill 10 in both the unfolded, operational configuration and the folded, generally upright configuration. The base frame 16 provides a movable surface on which a user may exercise, such as running, walking, jogging and the like. The motor frame 14 houses motors and control circuitry for controlling the elevation and the speed of the exercise surface of the base frame 16.

The support frame includes a base 18 and at least one vertical support 20. The support frame may also include a handle 21 and one or more arms 22 that the user may grasp during exercise for balance or support. A display device 24 may optionally be attached to the support frame 12 for displaying information to a user and for controlling the operation of the treadmill 10, as described in more detail below.

Figure 4:
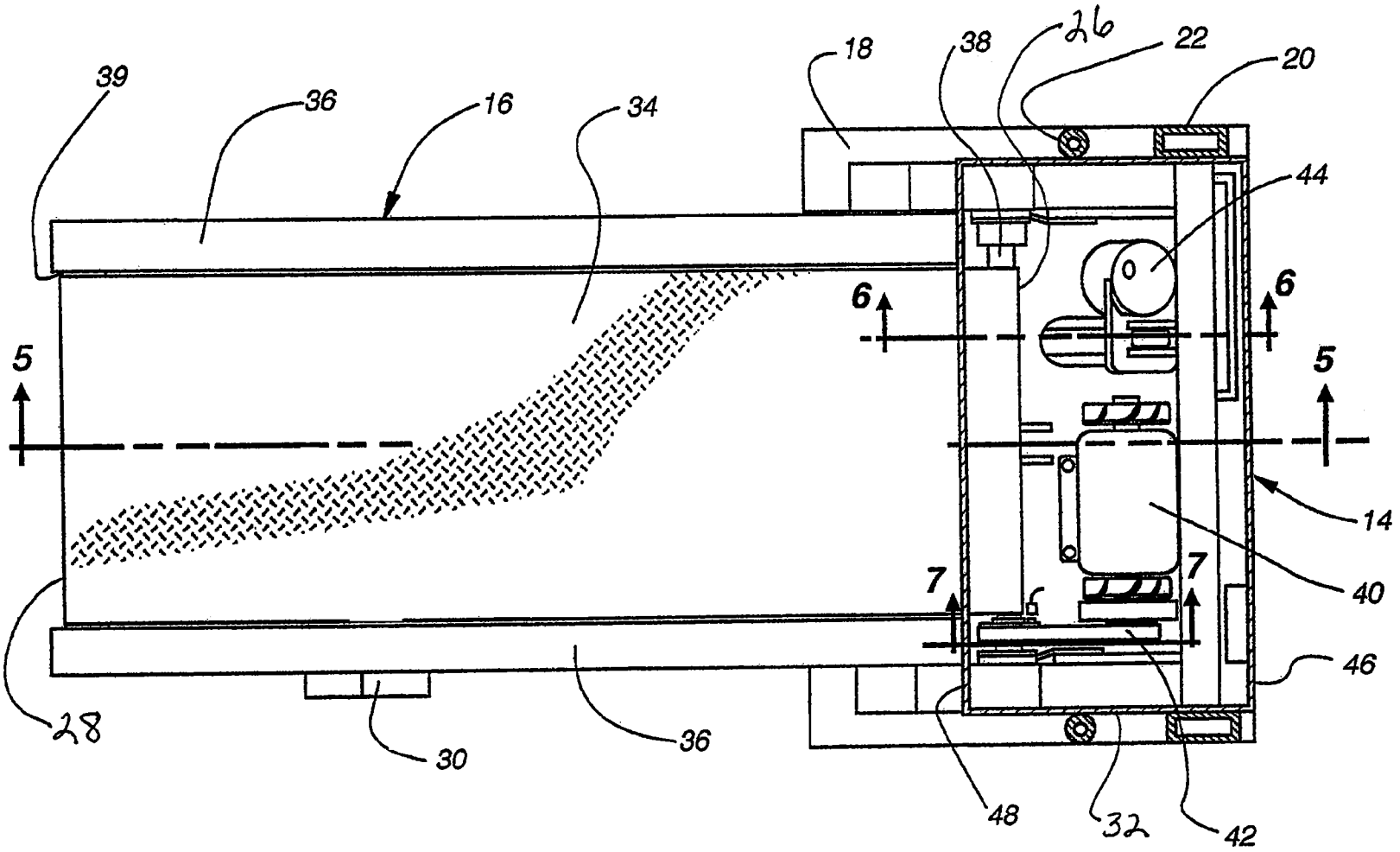
FIG. 4 is a top cross-sectional view of the treadmill taken along the section line 4-4 shown in FIG. 2.

The motor frame 14 is pivotally attached to the support frame 12 at or near a forward end 46 of the motor frame 14 and to the base frame 16 at or near a rear end 48 of the motor frame 14 (see FIG. 4). As the motor frame 14 pivots about the support frame 12, the motor frame 14 raises or lowers the front end 26 of the base frame in order to increase or decrease the incline angle of the base frame 16. For storage, the rear end 28 of the base frame 16 may be raised by pivoting the base frame 16 about the connection between the motor frame 14 and the front end 26 of the base frame 16. A retaining device, such as the hook 30, can be used to secure the base frame 16 in the upright position to the support frame 12.

FIG. 4 shows a top cross-sectional view of the treadmill 10 taken along the section line 4-4 (shown in FIG. 3) through the cover 32 of the motor frame 14, and the vertical supports 20 and the arms 22 of the support frame 12. The base frame 16 includes, among other elements, an endless belt 34, side rail members 36, and first and second elongated rollers 38 and 39. The first elongated roller 38 is rotatably mounted between side rail members 36 at the front end 26 of the base frame 16, and the second elongated roller 39 is rotatably mounted at the rear end 28 of the base frame 16. The endless belt 34 is looped about the first and second elongated rollers 38 and 39 to form a movable exercise surface. As described in more detail below, the first elongated roller 38 and/or the second elongated roller 39 are preferably mounted so that the roller angle is adjustable between the side rail members 36.

A drive motor 40 and an elevation motor 44 are mounted on the motor frame 14. The drive motor 40 drives the first roller 38 via the belt 42. The first roller 38, in turn, drives the endless belt 34 across the exercise surface of the treadmill 10. The elevation motor 44 pivots the motor frame 14 with respect to the support frame 12. As the motor frame 14 pivots about the support frame 12 at or near the first end 46 of the motor frame 14, the rear end 48 of the motor frame is raised or lowered. As the rear end 48 of the motor frame 14 raises or lowers, the motor frame 14 also raises or lowers the front end 26 of the base frame 16.

Figure 5:
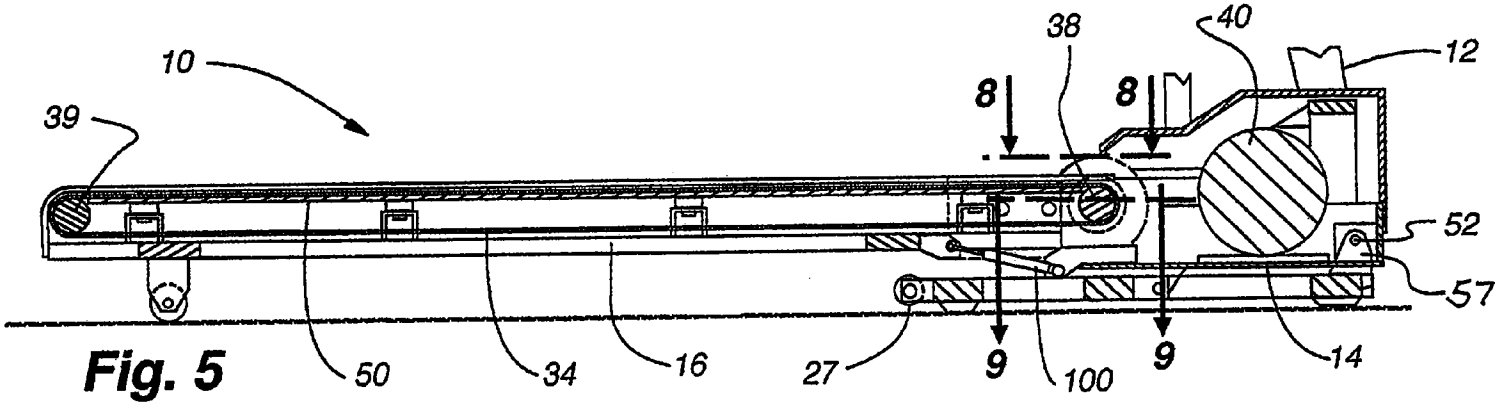
FIG. 5 is a cross-sectional view of the treadmill taken along the section line 5-5 shown in FIG. 4.

FIG. 5 is a cross-sectional view of the treadmill 10 taken along the section line 5-5 (shown in FIG. 4), which runs generally along the longitudinal centerline of the base frame 16. FIG. 5 shows the connection of the support frame 12 to the motor frame 14. As shown in FIG. 5, the motor frame 14 is connected on one side to a flange 51 of the support frame 12 at pivot point 52. The motor frame 14 is also connected to a second flange (not shown) on the opposite side of the support frame 12. The two pivot points form a pivot line on which the motor frame 14 pivots with respect to the support frame 12.

The endless belt 34 is looped about the first and second elongated rollers 38 and 39 and travels over a support bed 50 to define the exercise surface of the treadmill 10. The support bed 50 provides a rigid support surface to support the weight of a user exercising on the treadmill 10. The support bed 50 also preferably includes a cushioning layer such as a foam pad to reduce the stress on the user. The adjoining surfaces of the support bed 50 and/or the endless belt 34 are generally smooth so that the belt 34 does not snag on the support bed 50. In addition, one or both of the adjoining surfaces may comprise a low-friction material or may include a coating of such a material, e.g., Teflon™, so that the belt 34 slides easily over the support bed 50.

Figure 6:
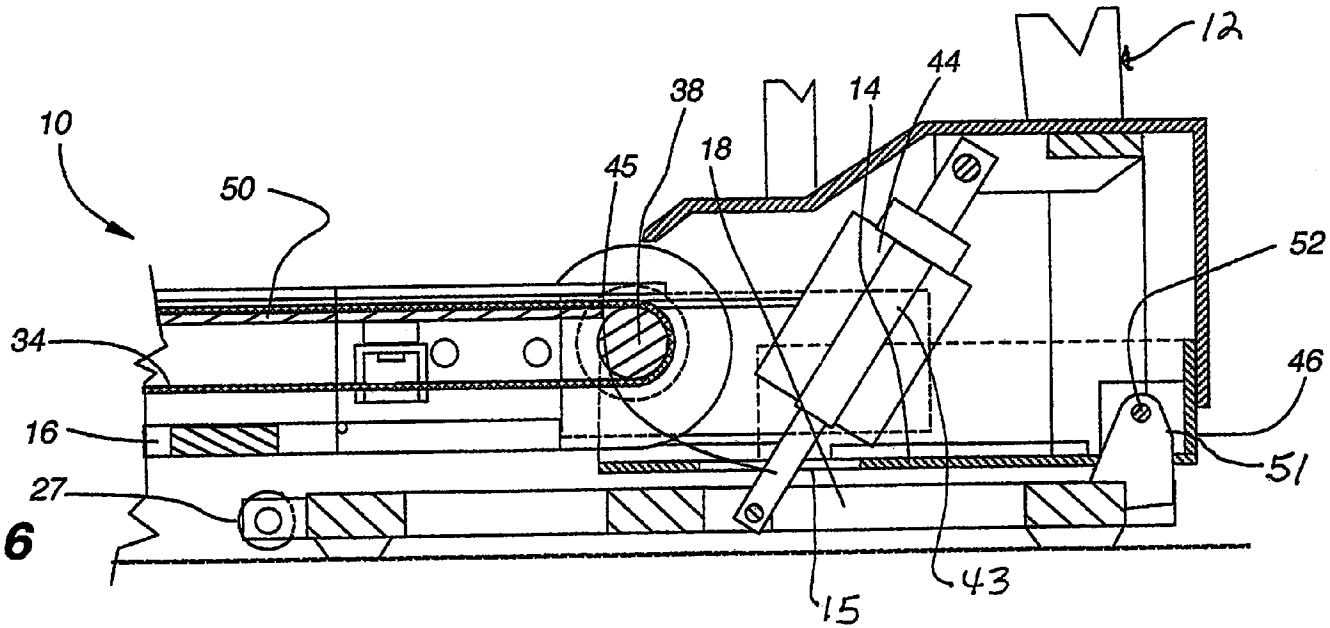
FIG. 6 is a cross-sectional view of the treadmill taken along the section line 6-6 shown in FIG. 4, wherein the front end of the treadmill base frame is lowered to provide a generally horizontal support bed.
Figure 6A:
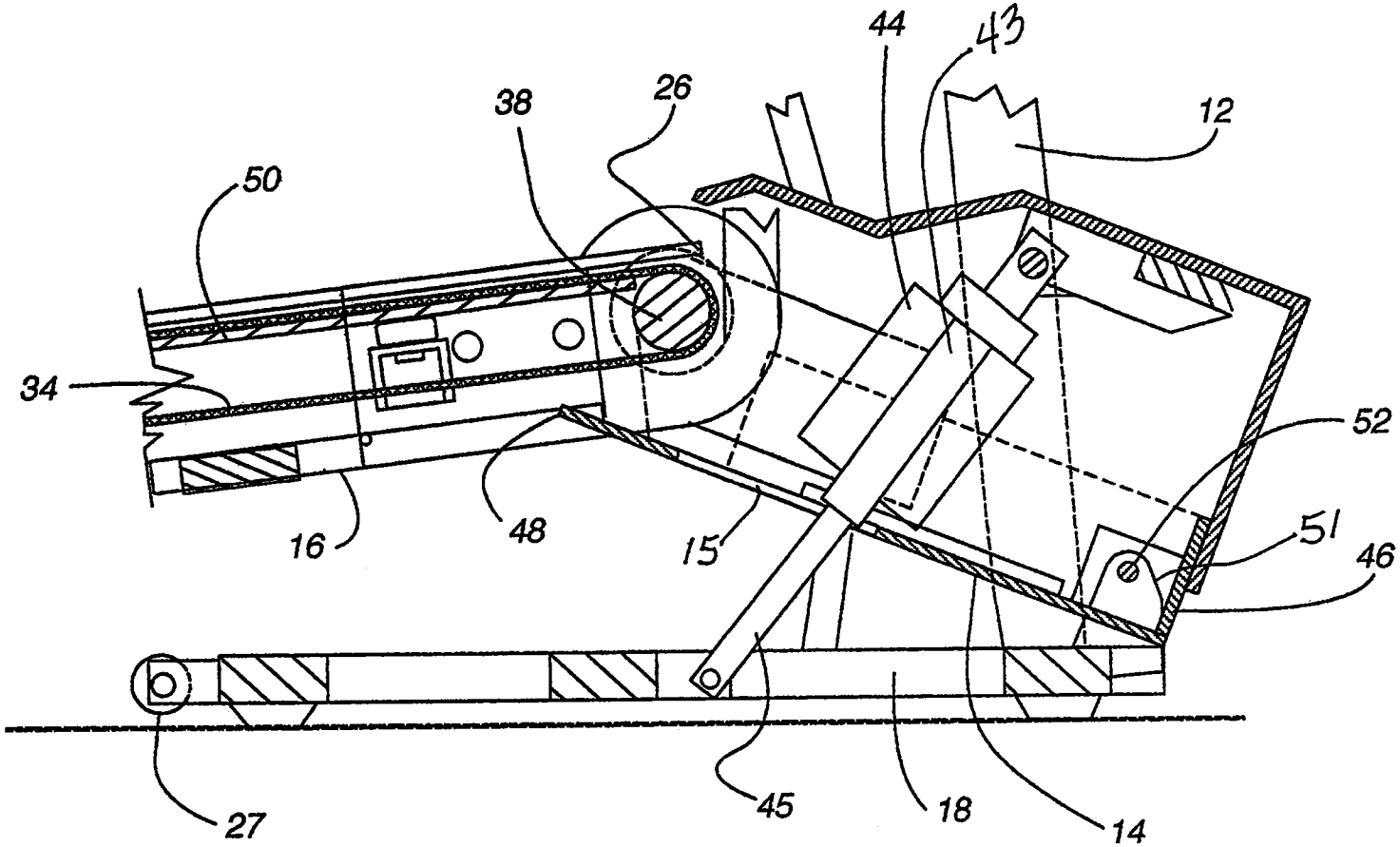
FIG. 6A is a cross-sectional view of the treadmill similar to that of FIG. 6, wherein the front end of the treadmill base frame is elevated to provide an inclined support surface.

FIGS. 6 and 6A show cross-sectional views of the connections of the support frame 12, the motor frame 14, and the base frame 16 of the treadmill 10 taken along the section line 6-6 (shown in FIG. 4). As shown in FIGS. 6 and 6A, the elevation motor 44 is mounted between the motor frame 14 and the base 18 of the support frame 12. The elevation motor 44 is preferably a threaded motor, such as an Acme threaded motor, in which a an extension arm 45 can be extended or retracted. The elevation motor body 43 is mounted to the motor frame 14. The extension arm 45 of the elevation motor 44 extends downwardly through an opening 15 in the motor frame 14 and is fixed to the base 18 of the support frame 12.

As shown in FIGS. 6 and 6A, the elevation motor 44 is mounted at angle to the base 18 of the support frame 12 so that as the extension arm 45 is extended or retracted into the body 43 of the elevation motor 44, the motor frame pivots with respect to the support frame 12 about a pivot line formed by pivot point 52 as described above in reference to FIG. 5. In FIG. 6, the extension arm 45 of the elevation motor 44 is in a retracted position, and the motor frame 14 and the support bed 50 of the treadmill 10 are in a generally horizontal orientation. In FIG. 6A, however, the extension arm 45 of the elevation motor 44 is in an extended position, and the rear end 48 of the motor frame 14 is angled upwards away from the support frame 12.

As the arm 45 of the elevation motor 44 extends and pushes the motor frame 14 away from the base 18 of the support frame 12, the front end 46 of the motor frame 14 rotates about the pivot line formed through the pivot point 52, and the rear end 48 of the motor frame 14 raises up away from the base 18 of the support frame 12. As the rear end 48 of the motor frame 14 is elevated, the front end 26 of the base frame 16 is raised. By raising the front end 26 of the base frame 16, the support bed 50 is angled upwards from the rear end 28 of the base frame 16 (see e.g., FIG. 1) to the front end 26 of the base frame 16. Thus, the extension and retraction of the extension arm 45 of the elevation motor 44 control the incline angle of the support bed 50. As the front end 26 of the base frame 16 is raised and lowered, the rear wheels 29, shown in FIG. 2, rotate along a support surface to allow the rear end 28 of the base frame 16 to move longitudinally as the front end 26 of the base frame 16 is raised and lowered.

The range of motion of the extension arm 45 of the elevation motor 44 determines the variance of the incline angle of the support bed 50 from a fully retracted position to a fully extended position of the extension arm 45. Thus, the greater the distance between the fully retracted position of the extension arm 45 to the fully extended position of the extension arm 45, the greater the angle that the support bed 50 may be raised from the generally horizontal position shown in FIG. 6.

FIG. 6A also shows the base 18 of the support frame 12, which provides a stable base for the treadmill 10 in both the unfolded, operational and folded, generally upright configurations. The base 18 extends rearwardly from the vertical support 20 underneath the motor frame 14 and beyond the pivot axis of the motor frame 14 and the base frame 16, which, as described below, extends coincidentally with the axis of rotation of the roller 38, so that the base 18 prevents the treadmill 10 from falling rearwardly when the base frame is in the folded, generally upright configuration shown in FIG. 3. The base 18 also includes a pair of flanges 51 to which the motor frame 14 is mounted. The base 18 includes feet 17 to prevent the treadmill 10 from rolling across the floor during operation or storage of the treadmill 10. As described in more detail below, the wheels 27 of the base 18 do not contact the ground unless the base is tilted backwards onto the wheels.

Figure 6B:
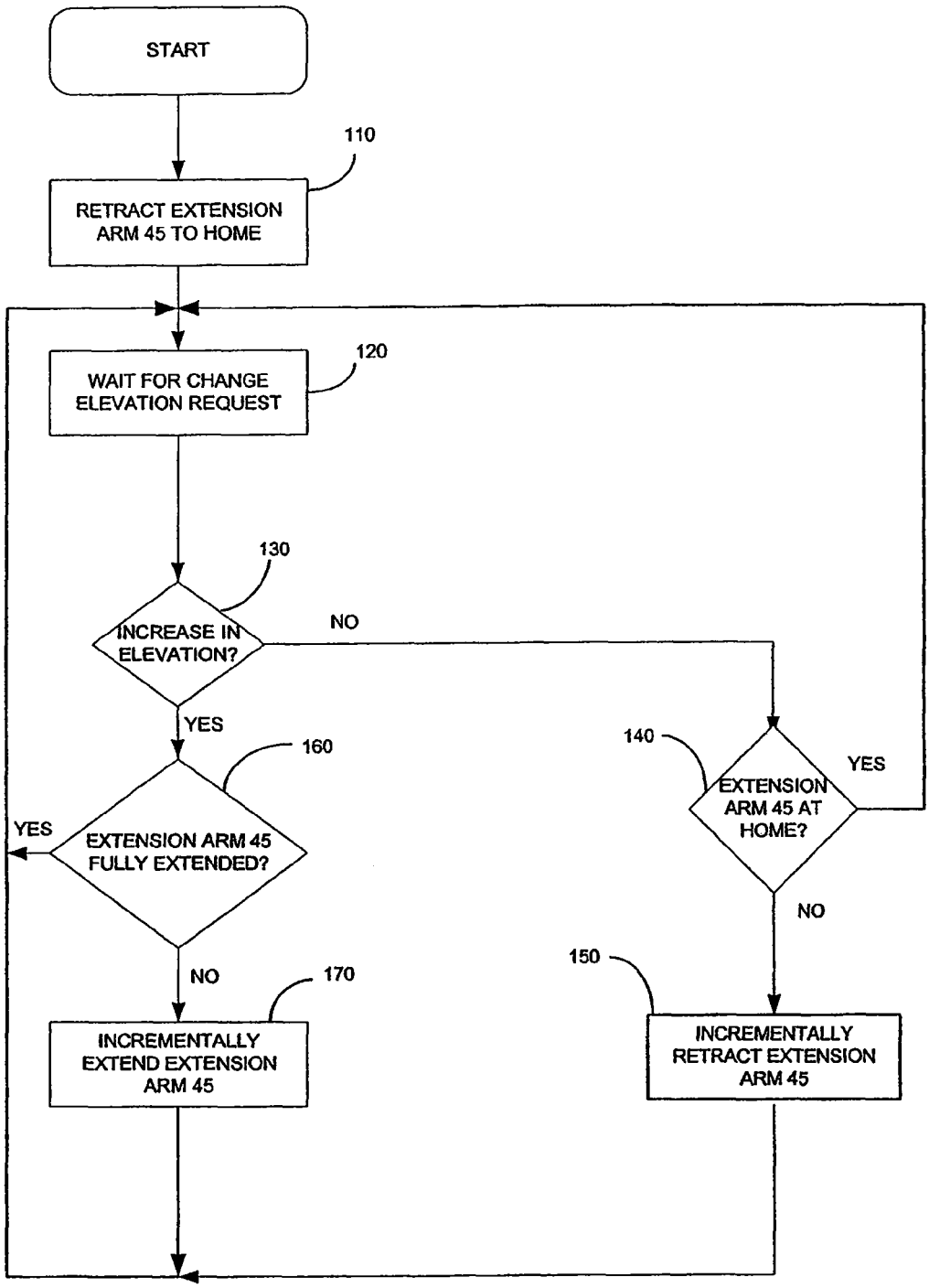
FIG. 6B is a block diagram of a control system for controlling the incline angle of the support bed of the treadmill.

FIG. 6B shows a block diagram of a control system that may be used to control the elevation motor 44, and, thus, to control the incline angle of the support bed 50. At power up, the extension arm is fully retracted to the home position at step 110 so that the support bed 50 starts off at a generally horizontal position. This allows a user to more easily climb onto the support bed. Then, the control system waits for a change in elevation request at step 120. When a change in elevation request is made, such as a user pushing a key on the display device 24 shown in FIG. 1, the control system determines whether the request is for an increase in elevation or a decrease in elevation at step 130. If the control system detects a decrease in elevation request at step 130, the control system next determines whether the extension arm is in the fully retracted, home position at step 140. If the extension arm 45 is already at the home position, the support bed is at the its lowest elevation, i.e., the generally horizontal position, and the control system returns to step 120 to wait for another elevation change request. If the extension arm 45 is not at the home position, however, the control system incrementally retracts the extension arm 45 of the elevation motor 44 by one increment at step 150 to lower the incline angle of the support bed 50 by one angular increment. The extension arm is preferably retracted or extended in constant incremental lengths for each time an elevation request is received. After the extension arm 45 has been retracted at step 150, the control system returns to step 120 to wait for another elevation change request.

If the elevation change request was determined to be for an increase in elevation at step 130, however, the control system next determines whether the extension arm is fully extended at step 160, i.e., whether the support bed 50 is at its highest elevation. If the extension arm 45 is already at its fully extended position, the control system returns to step 120 to wait for another elevation change request. If the extension arm 45 is not at the home position, however, the control system incrementally extends the extension arm 45 of the elevation motor 44 and by one increment at step 170 to increase the incline angle of the support bed 50 by one angular increment. After the extension arm 45 has been extended at step 170, the control system returns to step 120 to wait for another elevation change request. If desired, the control system may also receive an interrupt when the treadmill 10 is being powered down and fully extend the extension arm to raise the elevation of the support bed 50 to its highest position in order to make lifting the base frame 16 easier.

As shown in FIG. 1, the treadmill 10 has a lower profile in the unfolded, operational configuration than a treadmill that controls the incline of the support bed 50 of the base frame 16 by lowering the back end of the base frame 16. Since the incline angle of the support bed 50 of the treadmill 10 is controlled by raising the front end 26 of the base frame 16, as shown in FIG. 6A, instead of lowering the rear end 28 of the base frame 16, the rear end 28 of the base frame 16 does not have to be raised off the ground in the generally horizontal position of the support bed of the treadmill 10. Thus, the entire base frame 16 can be mounted closer to the ground when the support bed 50 is in the generally horizontal position. This, for example, allows for a user to more easily step on and off the treadmill without stumbling.

Figure 7:
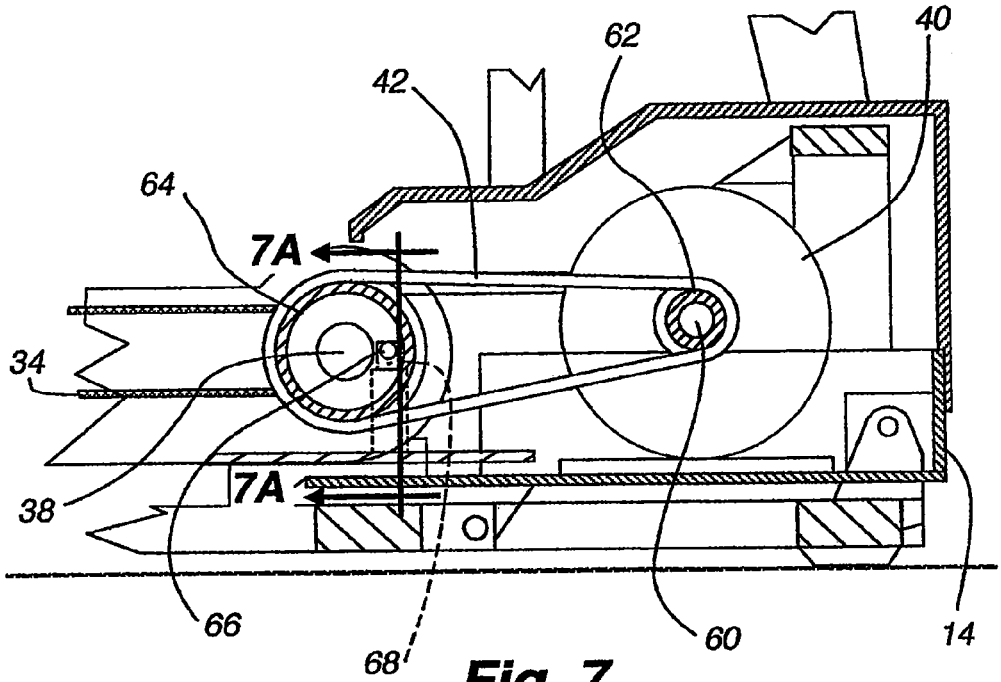
FIG. 7 is a cross-sectional view of the treadmill taken along the section line 7-7 shown in FIG. 4.

FIG. 7 shows a cross-sectional view of the treadmill 10 taken along the section line 7-7 (shown in FIG. 4). In FIG. 7, the drive mechanism for driving the endless belt 34 is shown. The drive motor 40 is mounted on the motor frame 14 and includes drive shaft 60 and pulley 62. The pulley 62 drives the belt 42, which, in turn, drives the pulley 64 mounted on the first roller 38 about which the endless belt 34 is trained.

Figure 7A:
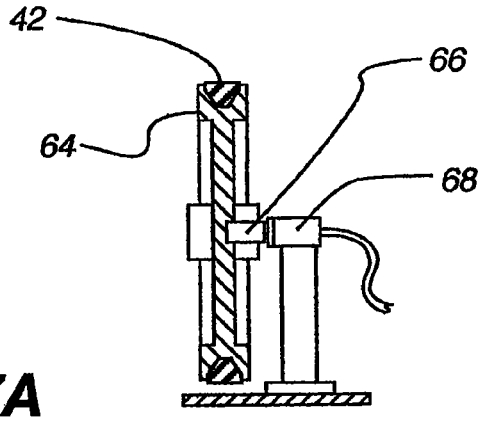
FIG. 7A is cross-sectional view of the treadmill taken along the section line 7A-7A shown in FIG. 7.

FIG. 7A shows a cross-sectional view of the treadmill 10 taken along the section line 7-7 (shown in FIG. 7). As shown in FIG. 7A, the drive belt resides in a groove of the pulley 64. The sensor pair 66 and 68 may collect information such as the rotational velocity of the pulley 64. The display device 24 may display the information collected, such as speed, distance, acceleration, and the like, or may even calculate other information from the information collected for display, such as elevation change traveled, estimated calories burned, and the like. The sensor pair 66 and 68 may, for example, be an optical sensor pair, an infrared sensor pair, or any other sensor technology known in the art.

Figure 8:
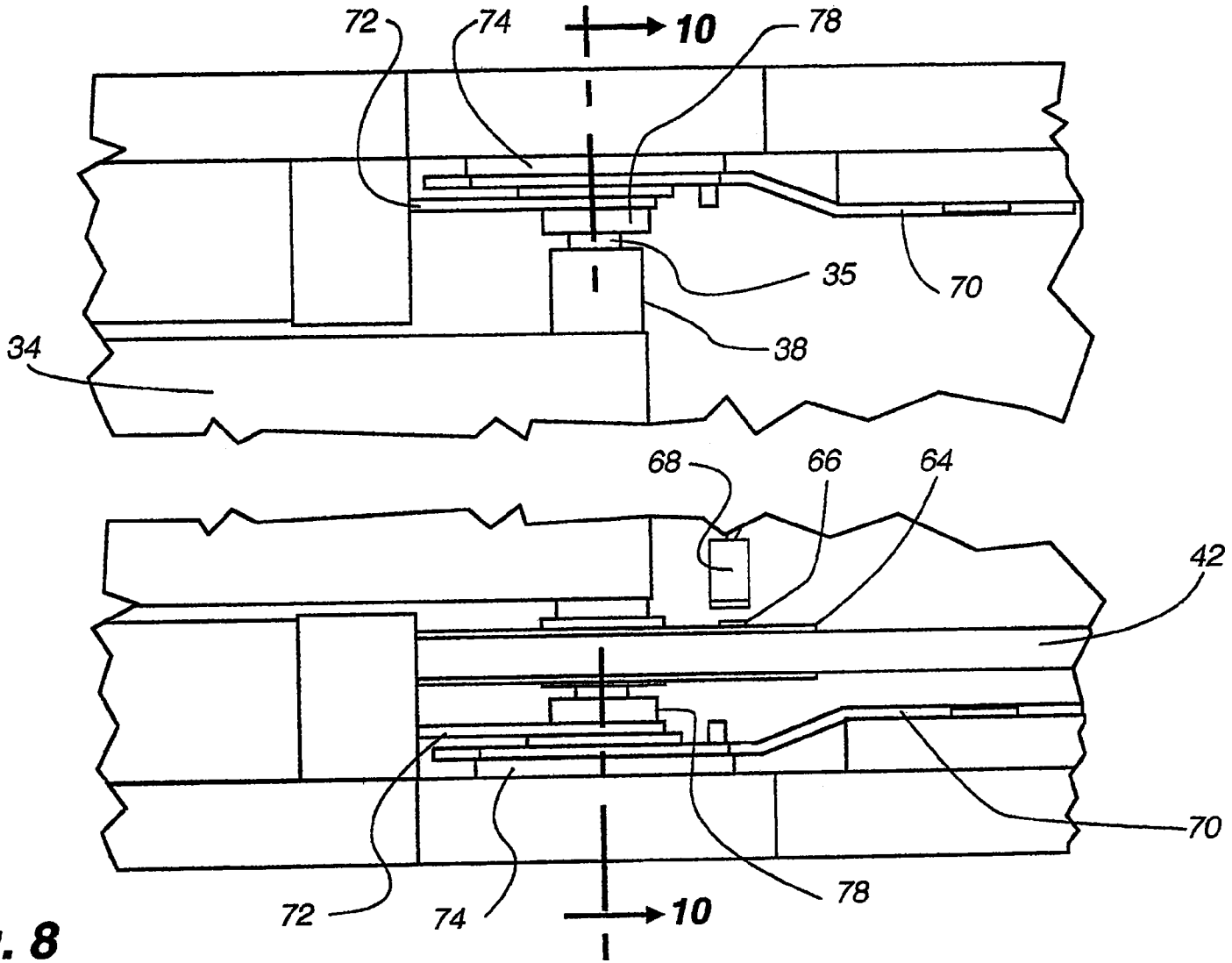
FIG. 8 is a broken top view of the treadmill of FIG. 1 with the cover of the motor frame removed.
Figure 8A:
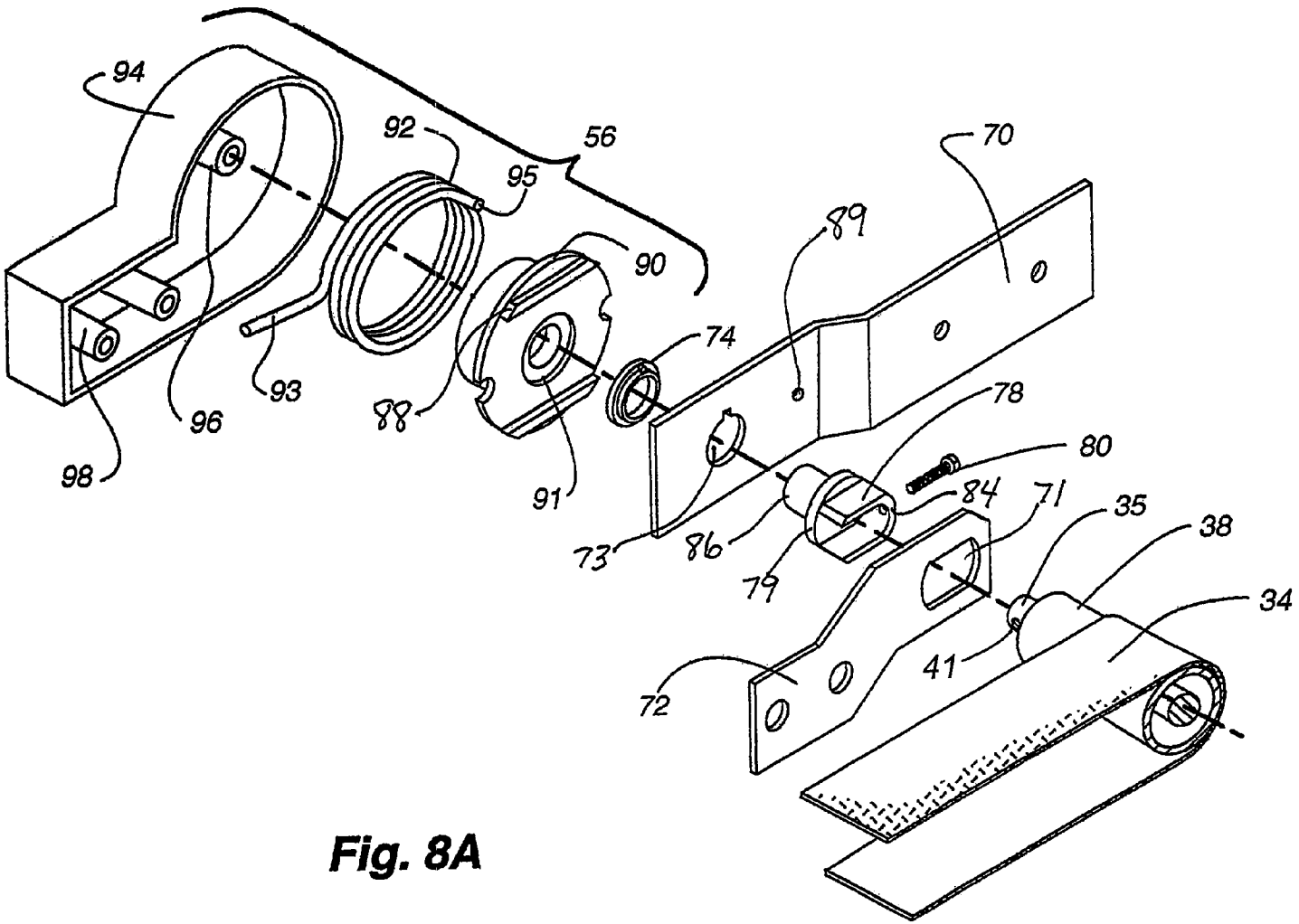
FIG. 8A is an exploded view of an embodiment of a pivotal connection of a treadmill of the present invention.
Figure 9:
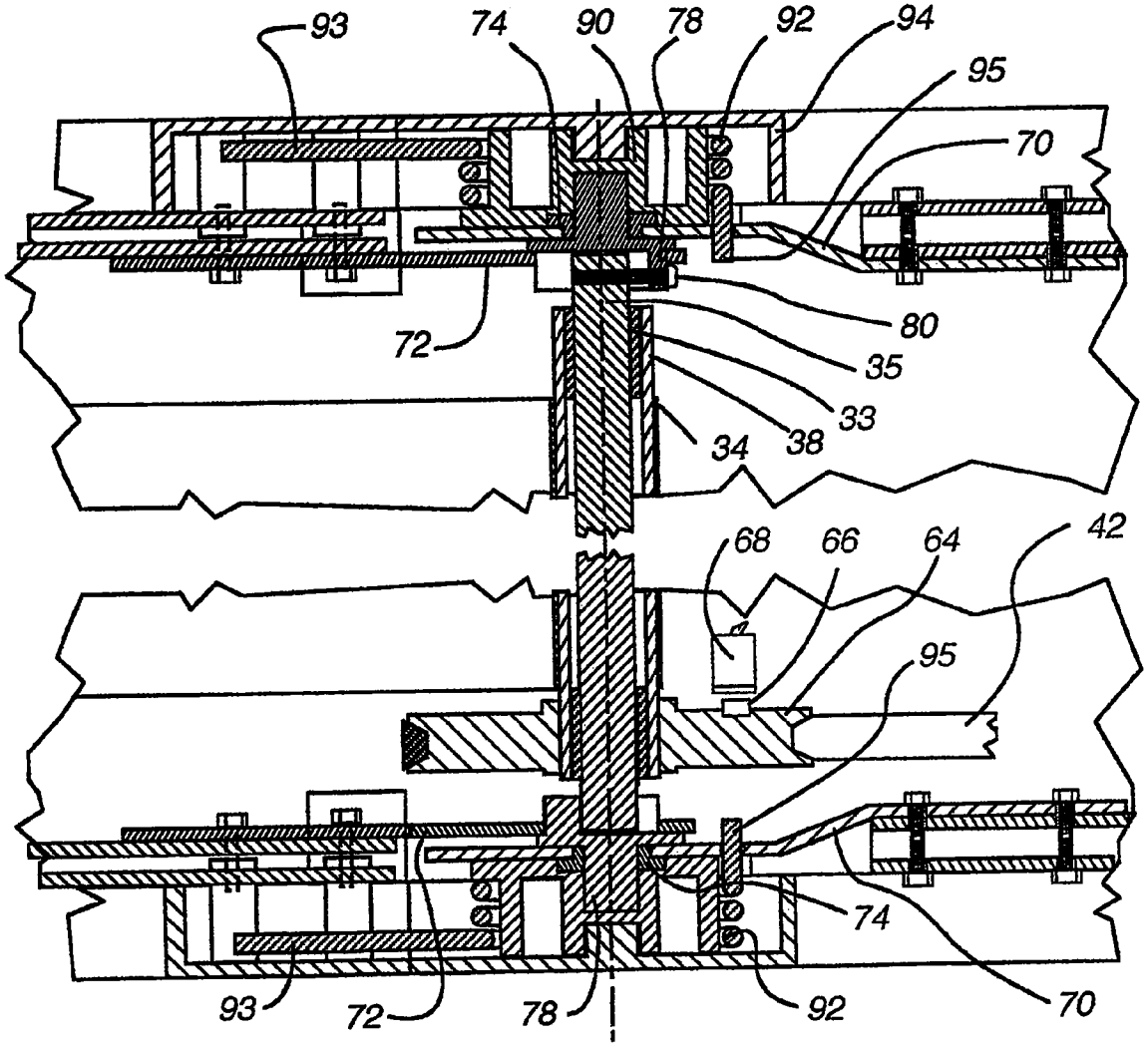
FIG. 9 is a broken cross-sectional view of the treadmill taken along the section line 9-9 shown in FIG. 5.

FIGS. 8 and 8A show the pivotal connection of the motor frame 14 and the base frame 16 of the treadmill 10. FIG. 8 shows a broken, top view of the connection of the motor frame 14 and the base frame 16 with the cover 32 of the motor frame 14 removed. FIG. 8A shows an exploded view of the components forming the pivotal connection on the non-drive side of the elongated roller 38 between the motor frame 14 and the base frame 16. The drive side connection is similar to that shown in FIG. 8A, but as can be seen in FIG. 9, a pulley 64 is mounted about the roller 38, the opening of the u-shaped inner bushing 78 is reversed, i.e., points forward towards the motor frame 14, and the inner bushing 78 does not include a threaded fastener 80.

The motor frame pivot brackets 70 are attached to the motor frame 14 and extend rearwardly from the motor frame 14 towards the ends of the axle 35. The base frame pivot brackets 72 are attached to the base frame 16 and extend forwardly towards the ends of the axle 35. The brackets 70 and 72 may be welded, bolted, riveted or attached to the respective frames by any other means known in the art. At the ends of the axle 35, the motor frame pivot brackets are generally parallel to each other and each of the brackets includes an aperture.

As can be seen more clearly in FIG. 8A, the ends of the axle 35 extend into the u-shaped opening of the inner bushing 78. On the non-drive side of the axle 35, the axle 35 includes a threaded recess 41 into which a threaded fastener 80 is engaged. The threaded fastener 80 holds the axle in the inner bushing 78, and, as described in more detail below, is used to adjust the angle of the roller to help align the roller so that the endless belt 34 is maintained in the desired orientation. On the non-drive side of the axle 35 (shown in FIG. 9), the u-shaped opening of the inner bushing 78 opens in the opposite direction, and the end of the axle extends into the u-shaped opening of the inner bushing 78. Instead of a fastener holding the drive side end of the axle in the inner bushing 78, the tension of the endless belt 34 holds the roller in the inner bushing 78.

The pivotal connections each include an outer bushing 74, a motor frame pivot bracket 70, a base frame pivot bracket 72, and an inner bushing 78. Opposite ends 84 and 86 of the inner bushing 78 extend through the apertures 71 and 73 of the base frame pivot bracket 72 and the motor frame pivot bracket 70, respectively. The flange 79 of the inner bushing 78 separates the brackets 70 and 72 and allows the brackets 70 and 72 to pivot with respect to each other about the inner bushing 78. The outer bushing 74 locks the motor frame pivot bracket 70 onto the inner bushing 78.

The pivotal connection also includes a spring pivot 56 to assist in lifting the base frame 16. The spring pivot 56 includes an inner casing 90, a spring coil 92, and an outer casing 94. The inner casing 90 includes a recess 91 and a pair of spaced parallel ribs 88. The recess 91 fits around the outer edge of the outer bushing 74. The parallel ribs 88 engage the outside of the motor frame pivot bracket 70 to anchor the inner casing 90 to the bracket 70 so that the inner casing 90 is not movable with respect to the bracket 70. The end 95 of the coil spring 92 anchors in the aperture 89 of the motor frame pivot bracket 70. The outer casing 94 includes a central post 96, which engages with the inner bushing 78, and one or more distal posts 98, which engage with the apertures 75 of the base frame pivot bracket 72, such as via two bolts, to secure the spring pivot 56 to the base frame 16.

Figure 11:
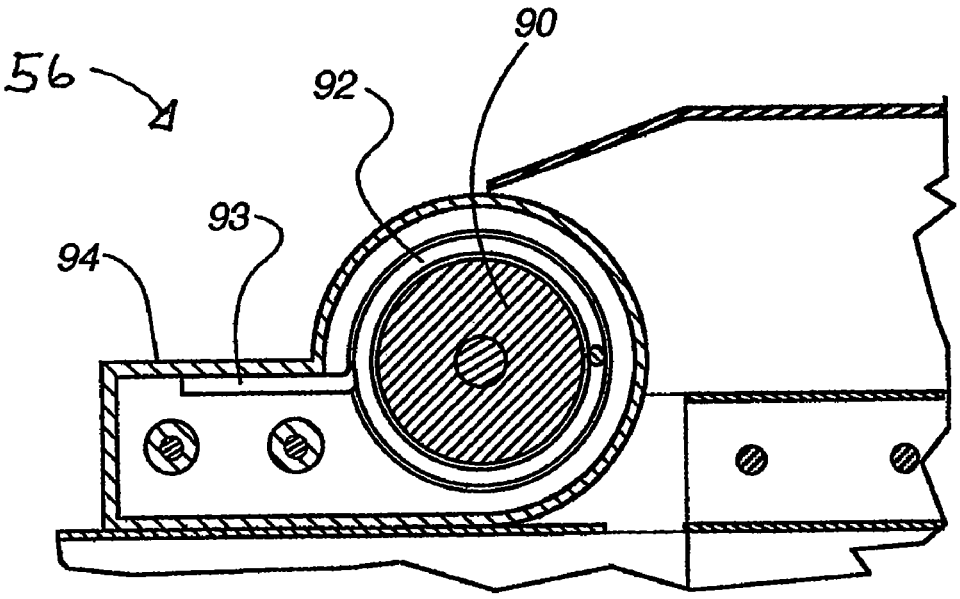
FIG. 11 is a cross-sectional view of the treadmill taken along the section line 11-11 shown in FIG. 10 when the base frame is in an unfolded, operational configuration.
Figure 11A:
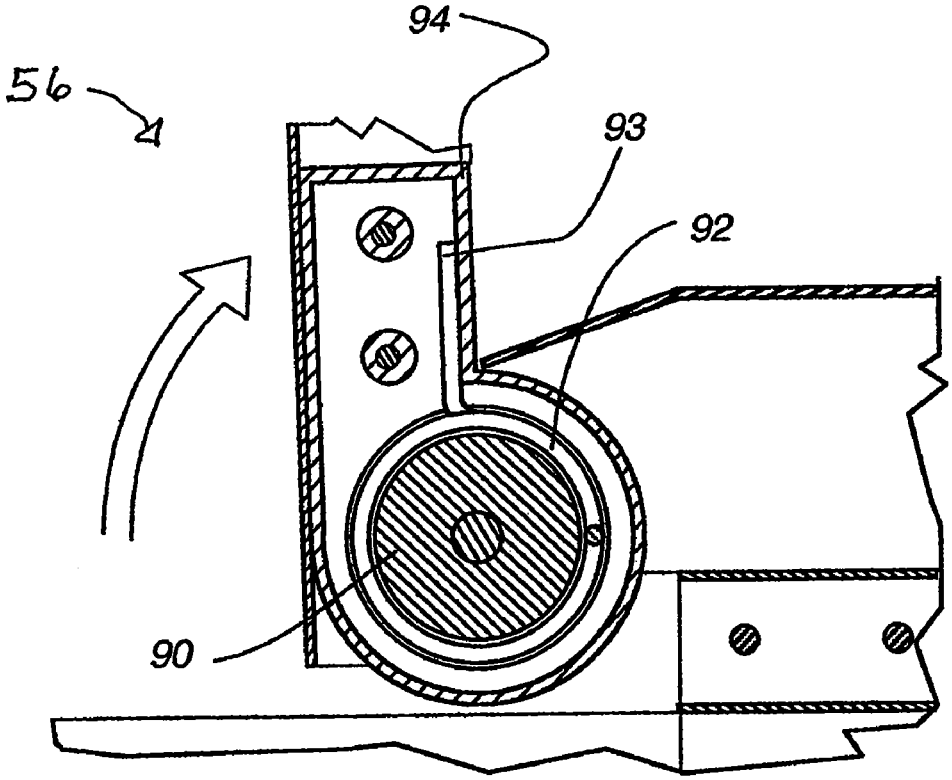
FIG. 11A is a cross-sectional view of the treadmill taken along the section line 11-11 shown in FIG. 10 when the base frame is in a folded, generally upright configuration.

As shown in FIGS. 11 and 11A, the tail 93 of the spring coil 92 engages the outer casing 94 of the spring pivot 56, and as the outer casing 94 rotates with respect to the inner casing 90, the spring coil 92 is loaded and unloaded, respectively. In FIG. 11, for example, the spring pivot 56 is oriented in a generally horizontal position that corresponds to the base frame being in the unfolded, operational configuration, such as shown in FIG. 1. In FIG. 11A, however, the spring pivot 56 is oriented in a generally vertical position that corresponds to the base frame being in the folded, generally upright configuration, such as shown in FIG. 3. The spring pivots 56 are preferably loaded when the base frame is in the unfolded, operational configuration, or are at least loaded for a portion of the distance from the unfolded, operational configuration to the generally upright, storage configuration. When the base frame 16 is lifted, the spring pivots thus provide a force to help urge the base frame 16 upward.

Figure 10:
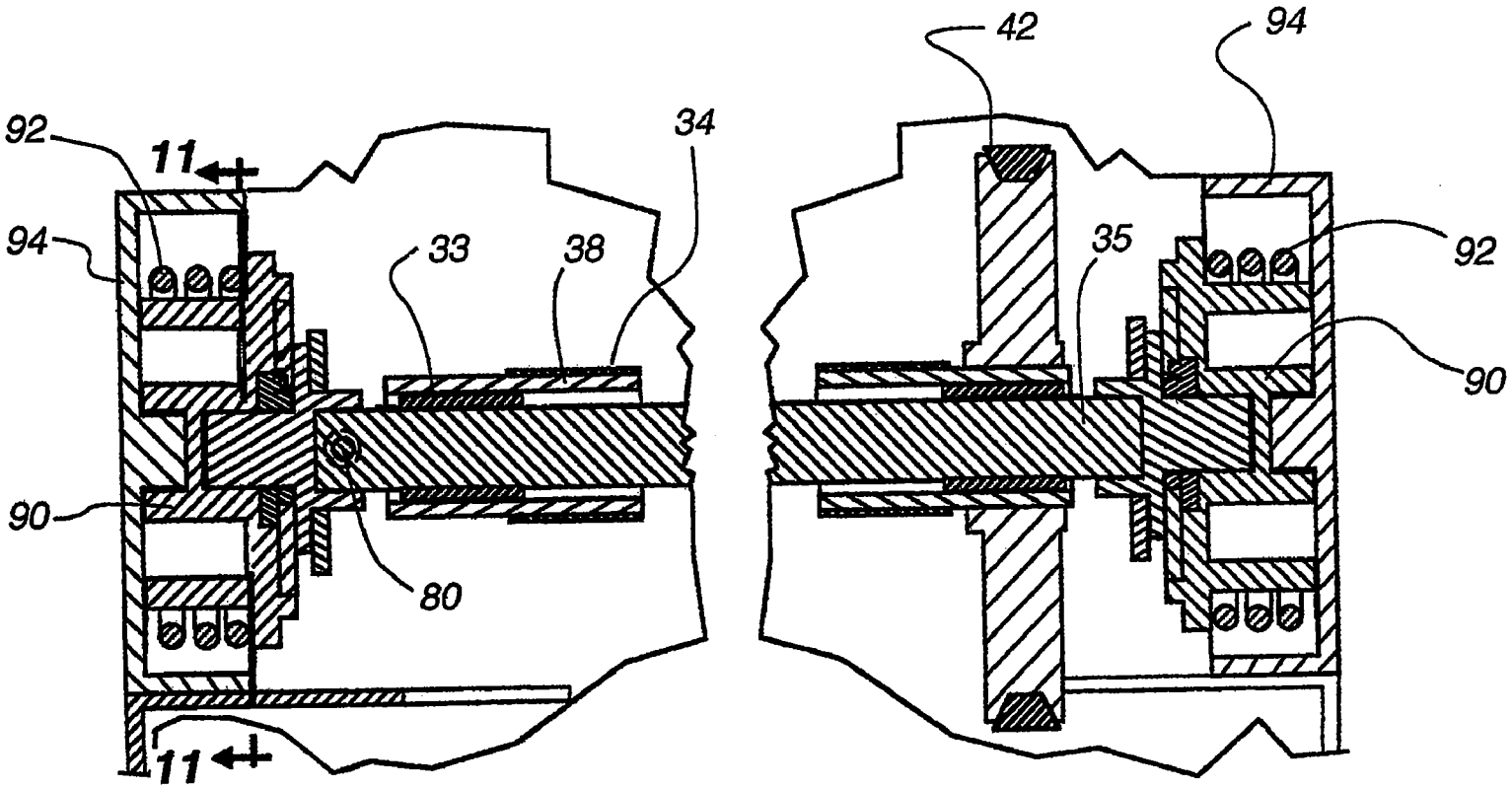
FIG. 10 is a broken cross-sectional view of the treadmill taken along the section line 10-10 shown in FIG. 8.

FIGS. 9 and 10 show broken, cross-sectional views of the treadmill 10 taken along the section lines 9-9 (shown in FIG. 5) and 10-10 (shown in FIG. 8) and are from a similar perspective as FIG. 8. FIGS. 9 and 10 show the pivotal connection of the motor frame 14 and the base frame 16 in further detail. The front roller 38 is rotatably mounted about axle 35. The roller 38 may, for example, be rotatably mounted about the axle 35 on a bearing 33 or other mounting known in the art. The axle 35 is seated in the u-shaped inner bushings 78. The opening of the drive side u-shaped inner bushing 78 faces forwardly and the axle is held in the drive side inner bushing 78 by the tension of the endless belt 34. On the opposite side, the bushing preferably includes a threaded fastener 80 that is attached through the inner bushing front wall and extends into a threaded aperture formed in the axle 35, holding it in place in the inner bushing 78. The threaded fastener 80 may further be used to adjust the angle of the roller to help align the roller 38 so that the endless belt 34 is in the desired orientation. By tightening or loosening the threaded fastener 80, the non-drive side of the axle 35 and the roller 38 may be adjusted forwardly or rearwardly, respectively, within the inner bushing 78. Further, the use of open-ended bushings allow for the roller 38 to be removed and/or replaced without having to disassemble the entire base frame 16 or the motor frame 14 assemblies of the pivot connection.

The second elongated roller 39 (shown in FIGS. 4 and 5) can also be adjustable, such as in the same manner as the first elongated roller 38 described above or in any other manner. The second elongated roller 39, for example, may be mounted on an axle such as the first elongated roller 38 is mounted on axle 35. The ends of the axle, on which the second elongated roller 39 is mounted, can extend into a pair of elongated openings, such as the u-shaped openings of the inner bushings 78 shown in FIGS. 8A, 9, and 10. Preferably, however, these openings are reversed in orientation from the u-shaped openings of the inner bushings 78 described above. On one end, the axle can include a threaded recess into which a threaded fastener, such as threaded fastener 80 described above, can be engaged. The threaded fastener extends through a wall of the elongated opening, holds the axle in the elongated opening, and is used to adjust the angle of the roller as described above with reference to the first elongated roller 38. On the opposite end of the axle, the elongated opening is preferably a u-shaped opening, such as the u-shaped opening of the inner bushing 78 described above. This u-shaped opening, however, preferably opens towards the rear end 28 of the base frame 16. Thus, the tension of the endless belt 34 will hold the roller in the u-shaped opening. Alternatively, the second elongated roller 39 can be fixed, or can be adjustable in any other manner.

Referring now to FIG. 1, the treadmill 10 may be folded into a generally upright configuration to move or store the treadmill 10. A user may lift the rear end 28 of the base frame 16 upwards toward the handle 21 of the support frame 12. As described above, the base frame 16 is pivotally connected to the motor frame 14. As the rear end 28 of the base frame 16 is lifted, the base frame 16 pivots about the motor frame 14 at the attachment point between the motor frame pivot bracket 70 and the base frame pivot bracket 72. The axis of rotation 13 of between the motor frame 14 and the base frame 16 is coincidental with the axis of rotation of the roller 38 as described above with reference to FIG. 9.

Since the base frame 16 pivots about the axis of rotation of the roller 38, the base frame may be lifted into the storage position shown in FIG. 3 regardless of whether the support bed 50 is in an inclined position or a generally horizontal position. It may also be desirable to automatically elevate the front end 26 of the base frame when the treadmill 10 is powered down in order to make the base frame 16 easier to lift. Then, when the treadmill is powered on, the elevation motor may automatically retract the extension arm 45, which will automatically lower the support bed 50 of the treadmill 10 to a generally horizontal starting position.

When the base frame 16 has been lifted into the generally upright configuration shown in FIG. 3, the hook 30 may be used to engage the handle 21 of the support frame 12 to secure the base frame in the upright configuration. Alternatively, however, many other engagement techniques known in the art may be used instead of, or in addition to, the hook 30. Other engagement mechanisms such as straps, cords, cables, sliding latches, and the like may be used to secure the base frame in the generally upright configuration.

When the base frame 16 is in the generally upright configuration, the treadmill 10 may be moved using the rear wheels or rollers 27 of the support frame 12. As shown in FIGS. 3, 5, 5, and 6A, the rear wheels are located on the rear end of the base 18 of the support frame 12 and are positioned above the bottom of the base 18. The treadmill 10 may be moved by leaning the treadmill 10 back towards a user after the base frame 16 has been secured in the generally upright configuration and rolling the treadmill 10 on the wheels 27. The rear wheels 27 of the support frame 12 allow the user to raise and secure the base frame 16, lean the treadmill 10 back onto the wheels 27, and to more easily move the treadmill 10 without having to walk around to the opposite side of the treadmill after securing the base frame 16. Further, because the wheels 27 do not project below the base 18 of the support frame 12, the treadmill will not roll on these wheels unless the base frame is in the upright position and the treadmill 10 is tilted back toward the wheels.

The treadmill 10 also preferably includes a damper 100 (shown in FIG. 1) that is attached to the base of the support frame 12 and the base frame 16. The damper acts to resist the weight of the base frame 16 when the base frame is being lowered from the generally upright configuration. Thus, the damper 100 prevents the base frame 16 from slamming into the ground when the base frame 16 is being lowered.

The treadmill of the present invention includes a support frame, a motor frame, and a base frame. The support frame includes a base and at least one vertical support. The motor frame is pivotally attached to the support frame about a first pivot line, and is pivotally attached to the base frame about a second pivot line spaced from the first pivot line. The treadmill preferably includes an elevation motor that pivots the motor frame about the fist pivot line. As the motor frame pivots with respect to the support frame, the motor frame also raises or lowers the front end of the base frame to change the incline angle of a support bed of the treadmill. Alternatively, the treadmill may include an adjustable roller system in which the roller is circumferentially mounted on an axle. The axle includes a threaded recess formed therein and is seated in a bushing. The bushing includes a threaded fastener that extends through a wall in the bushing into the threaded recess of the axle. The threaded fastener and the axle are adapted to adjust the position of the roller by engaging with the recess of the axle. In another embodiment, the base frame pivots about the second pivot line from an unfolded configuration to a folded configuration.

While the invention has been described in conjunction with the specific embodiments outlined above, it is evident that many alternatives, modifications, and variations will be apparent to those skilled in the art. Accordingly, the preferred embodiments of the invention are intended to be illustrative and not limiting. Various changes may be made without departing from the spirit and scope of the invention as defined in the following claims.

What is claimed is:

1. A treadmill comprising:

a support frame including a base;

a base frame supported by the support frame and configured to pivot relative to the support frame about a first pivot line at a front end of the base frame;

a front roller and a rear roller rotatably supported by the base frame;

an endless belt disposed about the front and rear rollers, the front roller including an axle that defines an axis about which the front roller is rotatable;

an adjustment mechanism configured to adjust a position of the axle of the front roller relative to the base frame without changing the first pivot line;

the base frame pivots relative to the support frame about the first pivot line to move the base frame between a use position and a storage position; and the base frame pivots relative to the support frame about the first pivot line to change an operational incline of the base frame.

2. The treadmill of claim 1, wherein an end of the axle of the front roller includes a threaded recess, the treadmill further comprising a threaded fastener configured to engage the threaded recess and to adjust the position of the axle of the front roller relative to the base frame.

3. The treadmill of claim 1, further comprising a first bushing coupled to the base frame along the first pivot line, the first bushing configured to provide a pivot structure for the base frame.

4. The treadmill of claim 3, wherein the first bushing is fixedly coupled to the base frame to pivot therewith.

5. The treadmill of claim 3, wherein the adjustment mechanism comprises:

a threaded recess in an end of the axle of the front roller; and a threaded fastener configured to engage the threaded recess and the first bushing, and to adjust the position of the axle of the front roller relative to the base frame.

6. The treadmill of claim 5, wherein the first bushing is fixedly coupled to the base frame to pivot therewith.

7. A treadmill comprising:

a support frame including a base;

a base frame supported by the support frame and configured to pivot relative to the support frame about a first pivot line at a front end of the base frame;

a front roller and a rear roller rotatably supported by the base frame;

an endless belt disposed about the front and rear rollers, the front roller including an axle that defines an axis about which the front roller is rotatable;

an adjustment mechanism configured to adjust a position of the axle of the front roller relative to the base frame without changing the first pivot line;

a first bushing coupled to the base frame along the first pivot line, the first bushing configured to provide a pivot structure for the base frame;

the first bushing includes an opening at one end configured to receive a first end of the axle of the front roller;

the adjustment mechanism includes a threaded recess in the axle of the front roller and a threaded fastener configured to engage the threaded recess; and rotation of the threaded fastener adjusts the position of the axle of the front roller within the opening of the first bushing.

8. The treadmill of claim 7, wherein the opening of the first bushing is a U-shaped opening that opens in a first direction toward the rear roller and the threaded fastener retains the first end of the axle of the front roller at least partially within the U-shaped opening.

9. The treadmill of claim 8, further comprising a second bushing, the second bushing including an opening at one end configured to receive a second end of the axle of the front roller, the opening of the second bushing being a U-shaped opening that opens in a second direction away from the rear roller and tension of the endless belt urges the second end of the axle of the front roller into the U-shaped opening.

10. A treadmill comprising:

a support frame including a base;

a base frame supported by the support frame and configured to pivot relative to the support frame about a first pivot line at a front end of the base frame;

a front roller and a rear roller rotatably supported by the base frame;

an endless belt disposed about the front and rear rollers, the front roller including an axle that defines an axis about which the front roller is rotatable; and an adjustment mechanism configured to adjust a position of the axle of the front roller relative to the base frame without changing the first pivot line;

a first bushing coupled to the base frame along the first pivot line, the first bushing configured to provide a pivot structure for the base frame;

a first structure of the base frame includes a first aperture;

a second structure of the support frame includes a second aperture; and opposite ends of the first bushing extend into the first and second apertures.

11. The treadmill of claim 10, wherein the first bushing includes a flange between the opposite ends, the flange separating the first and second structures.

12. The treadmill of claim 10, wherein the first bushing is fixedly coupled to one of the first and second structures and is rotatably coupled with the other one of the first and second structures.

13. The treadmill of claim 10, further comprising a coil spring configured to assist pivoting of the base frame relative to the support frame and into a storage position, a first end of the coil spring coupled to the first structure and a second end of the coil spring coupled to the second structure.

14. The treadmill of claim 10, wherein:

the first structure comprises a first bracket coupled to the base frame; and the second structure comprises a second bracket coupled to the support frame.

15. A method of configuring a treadmill including a support frame having a base, a base frame supported by the support frame and configured to pivot relative to the support frame about a first pivot line at a front end of the base frame, a front roller and a rear roller rotatably supported by the base frame, and an endless belt disposed about the front and rear rollers, the front roller including an axle that defines an axis about which the front roller is rotatable, the method comprising:

adjusting a position of the axle of the front roller relative to the base frame without changing the first pivot line about which the base frame pivots;

pivoting the base frame about the first pivot line relative to the support frame to change an operational incline of the base frame; and pivoting the base frame about the first pivot line relative to the support frame to move the base frame between a storage position and a use position.

* * * * *